US011811170B2

(12) United States Patent
Wang et al.

(10) Patent No.: US 11,811,170 B2
(45) Date of Patent: Nov. 7, 2023

(54) MALE CONNECTOR, FEMALE CONNECTOR AND CONNECTOR ASSEMBLY

(71) Applicants: Tyco Electronics (Shanghai) Co. Ltd., Shanghai (CN); Tyco Electronics Japan G.K., Kanagawa (JP)

(72) Inventors: Yingchun (David) Wang, Shanghai (CN); Yusuke Okada, Kanagawa (JP); Yong (Chris) Wang, Shanghai (CN); Liqiang (Gino) Yao, Shanghai (CN); Daokuan (Jeremy) Zhang, Shanghai (CN); Hua He, Shanghai (CN); Haibo (Robert) Gan, Shanghai (CN)

(73) Assignees: Tyco Electronics (Shanghai) Co., Ltd., Shanghai (CN); Tyco Electronics Japan G.K., Kawasaki (JP)

( * ) Notice: Subject to any disclaimer, the term of this patent is extended or adjusted under 35 U.S.C. 154(b) by 6 days.

(21) Appl. No.: 17/517,811

(22) Filed: Nov. 3, 2021

(65) Prior Publication Data

US 2022/0140539 A1 May 5, 2022

(30) Foreign Application Priority Data

Nov. 4, 2020 (CN) ..... 202022519230.2

(51) Int. Cl.

| | |
|---|---|
| ***H01R 13/6581*** | (2011.01) |
| ***H01R 13/58*** | (2006.01) |
| ***H01R 13/506*** | (2006.01) |

(52) U.S. Cl.

CPC ..... *H01R 13/6581* (2013.01); *H01R 13/506* (2013.01); *H01R 13/582* (2013.01)

(58) Field of Classification Search

CPC .. H01R 13/506; H01R 13/508; H01R 13/512; H01R 13/514; H01R 13/582; H01R 13/648; H01R 13/6581; H01R 13/6583

See application file for complete search history.

(56) References Cited

U.S. PATENT DOCUMENTS 3,056,942 A * 10/1962 Carbaugh ..... H01R 13/516 174/541
3,072,340 A * 1/1963 Dean ..... H01R 13/514 439/291
3,977,755 A * 8/1976 Edel ..... H01R 13/6581 439/607.47
4,337,989 A * 7/1982 Asick ..... H01R 13/6595 174/359

(Continued)

*Primary Examiner* — Oscar C Jimenez
(74) *Attorney, Agent, or Firm* — Barley Snyder

(57) ABSTRACT

A connector assembly comprising a male connector, and a female connector mateable to the male connector. Each of the male and female connectors include a shielding shell having two identical shielding half shells each comprising a bottom wall and a pair of side walls, a protrusion formed on one of the pair of side walls, and a latch formed on the other of the pair of side walls. The latch of one of the two shielding half shells engages with the protrusion of the other of the two shielding half shells for locking the two shielding half shells together. A terminal module is installed in each of the shielding shells. The terminal module and shielding shell of the male connector is adapted to be received within and electrically connected to the female connector.

17 Claims, 5 Drawing Sheets

(56) References Cited

U.S. PATENT DOCUMENTS

| | | | | |
|---|---|---|---|---|
| 6,231,392 | B1 * | 5/2001 | van Woensel ..... | H01R 13/5808<br>439/701 |
| 6,565,388 | B1 * | 5/2003 | Van Woensel ..... | H01R 13/514<br>439/357 |
| 7,762,846 | B1 * | 7/2010 | Whiteman, Jr. ..... | H01R 13/514<br>439/607.1 |
| 2012/0015551 | A1 * | 1/2012 | Tobey ..... | H01R 13/65915<br>439/607.41 |

* cited by examiner

MALE CONNECTOR, FEMALE CONNECTOR AND CONNECTOR ASSEMBLY

CROSS-REFERENCE TO RELATED APPLICATIONS

This application claims the benefit of Chinese Patent Application No. 202022519230.2 filed on Nov. 4, 2020 in the State Intellectual Property Office of China, the whole disclosure of which is incorporated herein by reference.

FIELD OF THE INVENTION

The present invention relates to a male connector, a female connector, and a connector assembly comprising the male connector and the female connector.

BACKGROUND

According to an embodiment of the prior art, a shielded electrical connector assembly includes an outer shielding shell and a plurality of conductive electrical terminals. The shielding shell generally comprises a main shell body having a top opening, and a top cover mounted over the top opening. The plurality of terminals are mounted within the shielding shell. The top cover is typically fixed to top of the main shell body and over the opening via a plurality of fasteners, such as screws. As a result of the relatively high number of components, both the complexity and cost of manufacturing the assembly are undesirably high.

Accordingly, there is a need for improved shielded electrical connector assemblies having a reduced number of components for decreasing cost and reducing manufacturing complexity.

SUMMARY

According to an embodiment of the present disclosure, a connector assembly comprises a male connector, and a female connector mateable to the male connector. Each of the male and female connectors include a shielding shell having two identical shielding half shells each comprising a bottom wall and a pair of side walls, a protrusion formed on one of the pair of side walls, and a latch formed on the other of the pair of side walls. The latch of one of the two shielding half shells engages with the protrusion of the other of the two shielding half shells for locking the two shielding half shells together. A terminal module is installed in each of the shielding shells. The terminal module and shielding shell of the male connector is adapted to be received within and electrically connected to the female connector.

BRIEF DESCRIPTION OF THE DRAWINGS

The invention will now be described by way of example with reference to the accompanying Figures, of which.

DETAILED DESCRIPTION OF THE EMBODIMENTS

Figure 1:
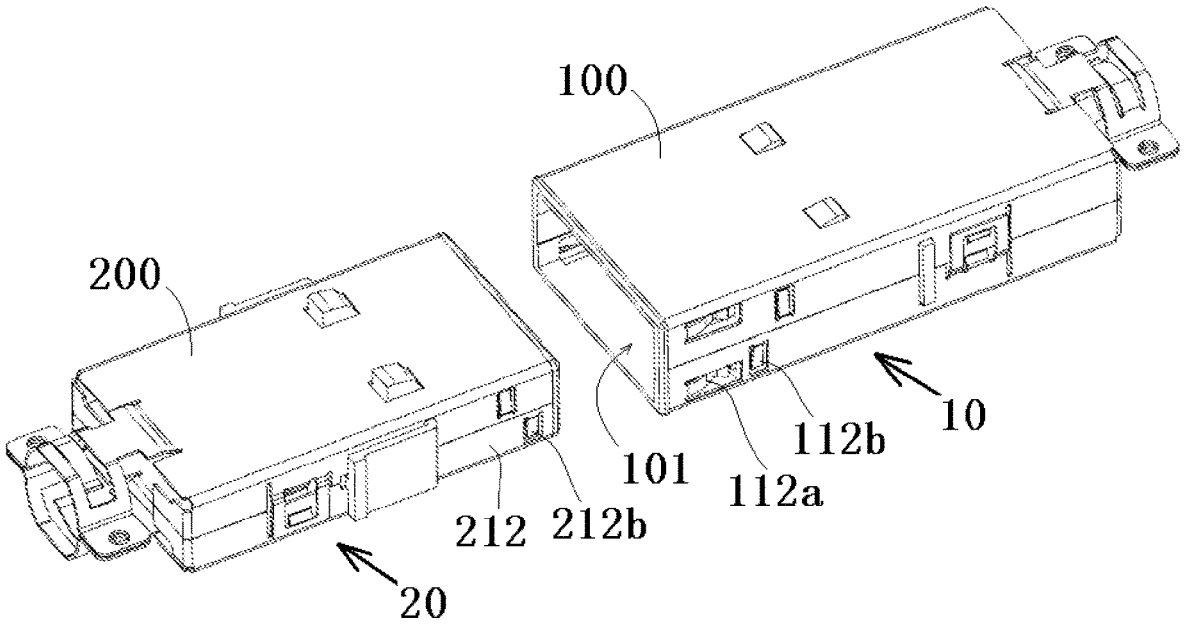
FIG. 1 is an illustrative perspective view of a connector assembly according to an exemplary embodiment of the present invention.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a male connector comprises a first shielding shell and a first terminal module installed in the first shielding shell. The first shielding shell includes two identical first shielding half shells, each comprising a first bottom wall and a pair of first side walls. A first protrusion is formed on one of the pair of first side walls, and a first latch is formed on the other of the pair of first side walls. The first latch of one of the two first shielding half shells is locked on the first protrusion of the other of the two first shielding half shells, so as to lock the two first shielding half shells together.

According to another embodiment of the present disclosure, a female connector comprises a second shielding shell and a second terminal module installed in the second shielding shell. The second shielding shell includes two identical second shielding half shells each comprising a second bottom wall and a pair of second side walls. A second protrusion is formed on one of the pair of second side walls, and a second latch is formed on the other of the pair of second side walls. The second latch of one of the two second shielding half shells is locked on the second protrusion of the other of the two second shielding half shells, so as to lock the two second shielding half shells together.

According to another embodiment of the present disclosure, a connector assembly includes the above-described male and female connectors The male connector is adapted to be mated with the female connector so that the first terminal module of the male connector is electrically connected with the second terminal module of the female connector.

FIG. 1 is an illustrative perspective view of a connector assembly according to an exemplary embodiment of the present invention. As shown in FIG. 1, in an embodiment, the connector assembly includes a male connector 10 and a female connector 20. The male connector 10 mateable with the female connector 20. The features of the male connector 10 and the female connector 20 will be described in detail below with reference to the drawings.

Figure 2:
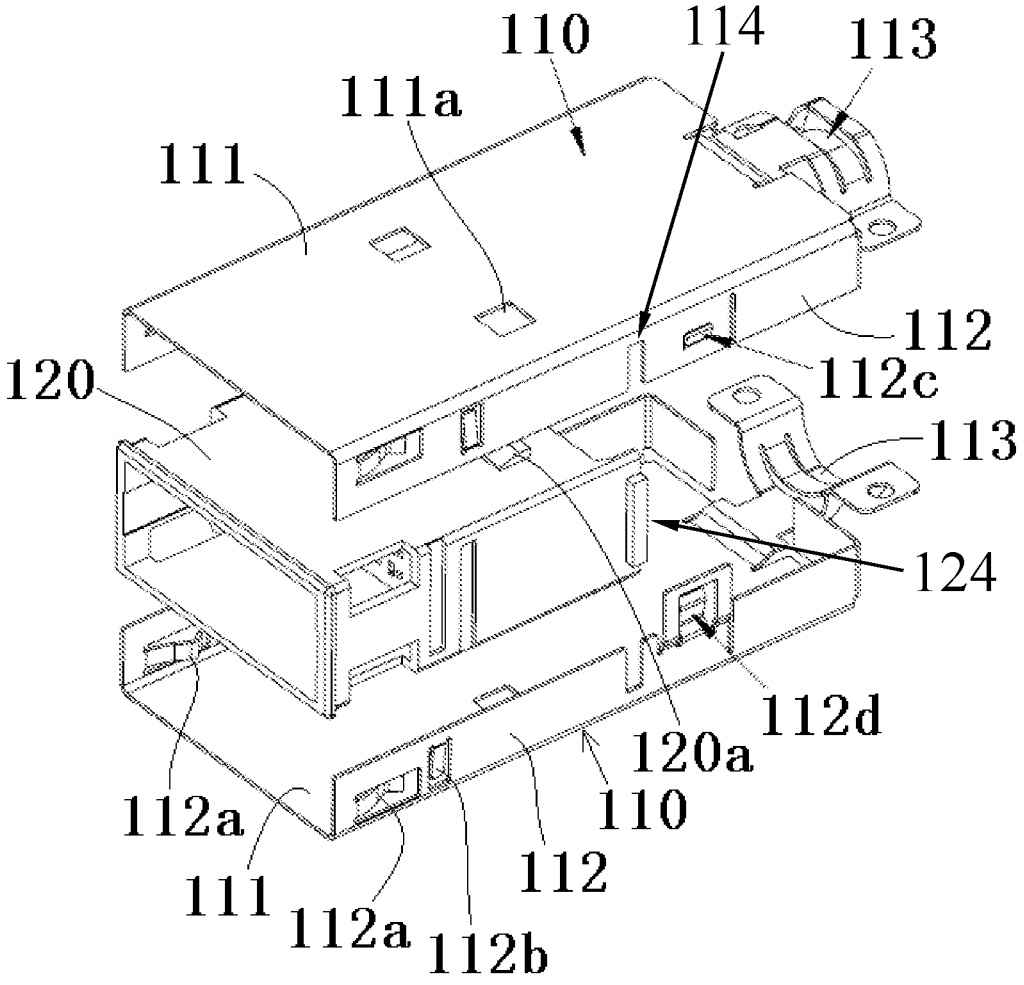
FIG. 2 is an illustrative exploded view of the male connector in the connector assembly shown in FIG. 1.
Figure 3:
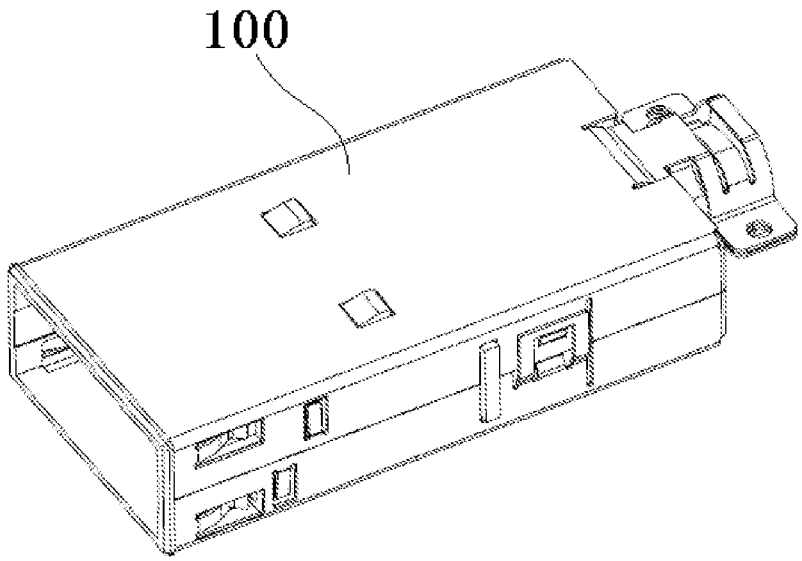
FIG. 3 is an illustrative assembled view of the male connector shown in FIG. 2.
Figure 4:
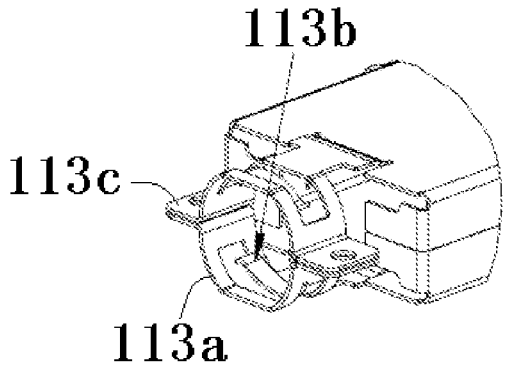
FIG. 4 is an illustrative view of a cable clip of the male connector shown in FIG. 3.

FIG. 2 is an illustrative exploded view of the male connector 10 of the connector assembly shown in FIG. 1. FIG. 3 is an illustrative assembled view of the male connector 10 shown in FIG. 2. FIG. 4 is an illustrative view of a cable clip 113 of the male connector 10 shown in FIG. 3. As shown in FIGS. 1-4, in an embodiment, the male connector 10 includes a first shielding shell 100 and a first terminal module 120 installed in the first shielding shell 100.

The first shielding shell 100 includes two identical first shielding half shells 110. Each of the two identical first shielding half shells 110 comprises a first bottom wall 111 and a pair of first side walls 112. A first protrusion 112*c* is formed on one of the pair of first side walls 112, and a first latch 112*d* is formed on the other of the pair of first side walls. The first latch 112*d* of one of the two first shielding half shells 110 is locked on the first protrusion 112*c* of the other of the two first shielding half shells, so as to lock the two first shielding half shells together.

In an embodiment, the first terminal module 120 may define a first insulating body having a first conductive terminal arranged therein. As a single integral functional module, the first terminal module 120 can simplify the assembly process of the connector 10. The first terminal module 120 is adapted to be electrical connected to a first cable (not shown) introduced into a rear end of the first shielding shell 100. A first cable clip 113 is formed at the rear end of the first bottom wall 111 of each first shielding half shell 110. The first cable is adapted to be clamped and fixed between the two first cable clips 113 of the two first shielding half shells 110.

In an embodiment, each first cable clip 113 comprises a first half annular body part 113*a* and two first ear parts or tabs 113*c* respectively connected to both sides of the first half annular body part 113*a*. The first ear parts 113*c* of the two first cable clips 113 are adapted to be fixed together by a bolt to clamp and fix the first cable between the first half annular body parts 113*a* of the two first cable clips 113. In an embodiment, each first cable clip 113 further comprises a first elastic clamping arm 113*b* formed on the first half annular body part 113*a*. The first elastic clamping arm 113*b* is adapted to press the clamped first cable to improve a clamping force on the first cable.

As shown in FIG. 2, a plurality of first positioning bumps 120*a* are formed on respective the top and bottom surfaces of the first terminal module 120. A plurality of first positioning holes 111*a* are formed in the first bottom walls 111 of the two first shielding half shells 110 to fit with or receive the first positioning bumps 120*a*, respectively. Likewise, as shown in FIG. 2, lateral positioning protrusions 124 are formed on each lateral side surface of the terminal module 120 for engaging with complementary slots 114 formed on each side wall of each shielding shell half for locating the terminal module within the shielding shell in an axial direction of the connector.

Figure 5:
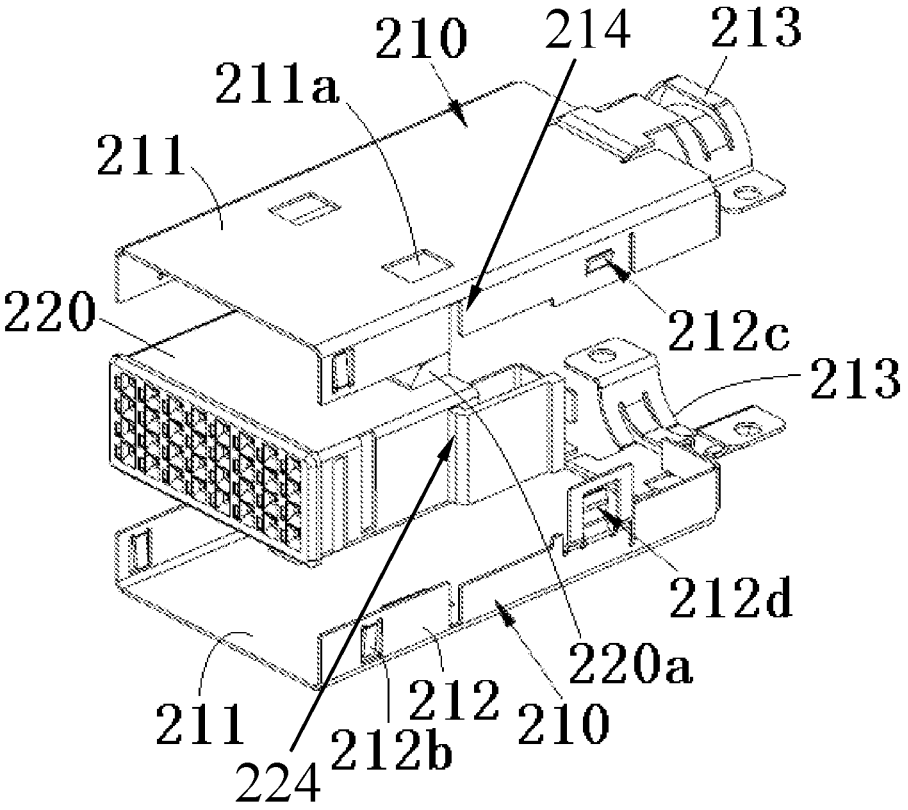
FIG. 5 is an illustrative exploded view of the female connector in the connector assembly shown in FIG. 1.
Figure 6:
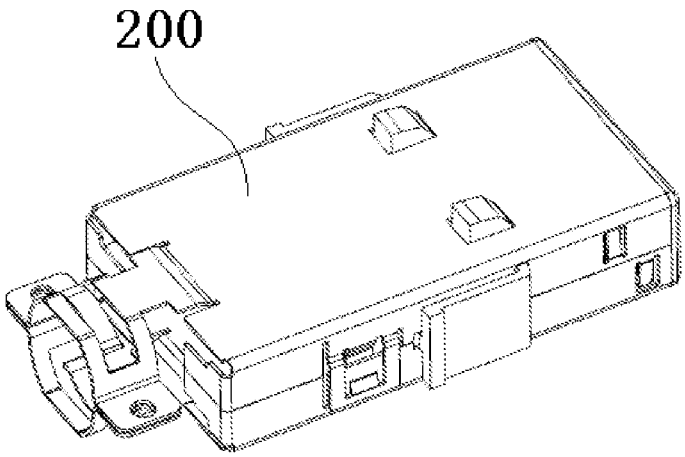
FIG. 6 is an illustrative assembled view of the female connector shown in FIG. 5.
Figure 7:
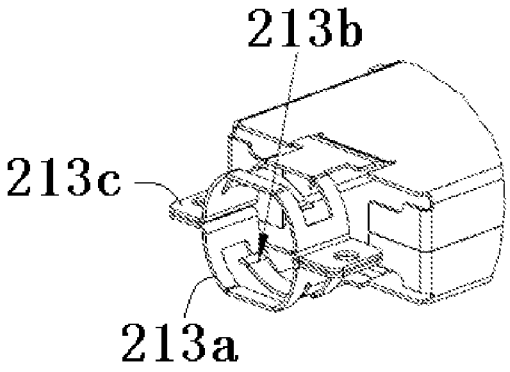
FIG. 7 is an illustrative view of a cable clip of the female connector shown in FIG. 6.

FIG. 5 is an illustrative exploded view of the female connector 20 in the connector assembly shown in FIG. 1. FIG. 6 is an illustrative assembled view of the female connector 20 shown in FIG. 5. FIG. 7 is an illustrative view of a cable clip 213 of the female connector 20 shown in FIG. 6. As shown in FIG. 1 and FIGS. 5-7, in an embodiment, the female connector includes a second shielding shell 200 and a second terminal module 220 installed in the second shielding shell 200.

According to one embodiment, the second shielding shell 200 includes two identical second shielding half shells 210. Each of the two identical second shielding half shells 210 comprises a second bottom wall 211 and a pair of second side walls 212. A second protrusion 212*c* is formed on one of the pair of second side walls 212, and a second latch 212*d* is formed on the other of the pair of second side walls. The second latch 212*d* of one of the two second shielding half shells 210 is locked on the second protrusion 212*c* of the other of the two second shielding half shells, so as to fix the two second shielding half shells together. According to one embodiment, the second terminal module 220 may include a second insulating body and a second conductive terminal disposed within the second insulating body. The second terminal module 220 defines a single integral function module, simplifying the assembly operation of the connector.

Still referring to FIG. 1 and FIGS. 5-7, in an embodiment, the second terminal module 220 is adapted to electrical connect to a second cable (not shown) introduced into a rear end of the second shielding shell 200. A second cable clip 213 is formed at the rear end of the second bottom wall 211 of each second shielding half shell 210, wherein the second cable is adapted to be clamped and fixed between the two second cable clips of the two second shielding half shells. Each of the second cable clips 213 comprises a second half annular body part 213*a* and two second ear parts 213*c* respectively connected to both sides of the second half annular body part. The second ear parts 213*c* of the two second cable clips 213 are adapted to be fixed together by a bolt to clamp and fix the second cable between the second half annular body parts 213*a* of the two second cable clips. In an embodiment, each of the second cable clips 213 further comprises a second elastic clamping arm 213*b* formed on the second half annular body part 213*a*. The second elastic clamping arm 213*b* is adapted to press the clamped second cable for increasing a clamping force on the second cable.

As shown in FIG. 5, a plurality of second positioning bumps 220*a* are respectively formed on the top and bottom surfaces of the second terminal module 220. A plurality of second positioning holes 211*a* are formed in the second bottom walls 211 of the two second shielding half shells 210 to fit with or receive the second positioning bumps 220*a*, respectively. Likewise, as shown in FIG. 5, lateral positioning protrusions 224 are formed on each lateral side surface of the terminal module 220 for engaging with complementary slots 214 formed on each side wall of each shielding shell half for locating the terminal module within the shielding shell in an axial direction of the connector.

As shown in FIG. 1, as the male connector 10 is mated to the female connector 20, the first terminal module 120 (see FIG. 2) of the male connector 10 is electrically connected with the second terminal module 220 (see FIG. 5) of the female connector 20. More specifically, as shown in FIGS. 1-2 and FIG. 5*a*, a front end of the second shielding shell 200 of the female connector 20 is adapted to be inserted into a front end opening 101 of the first shielding shell 100 of the male connector 10. An elastic contact terminal 112*a* is formed on the first side wall 112 of each first shielding half shell 110 of the male connector 10. The elastic contact terminal 112*a* is adapted to electrically contact the second side wall 212 of the second shielding shell 200 of the inserted female connector 20. In this way, an electromagnetic shielding effect of the two mated connectors is improved.

In an embodiment, the male connector 10 and the female connector 20 are adapted to be latched together. For example, an elastic latch 112*b* is formed on the first side wall 112 of each first shielding half shell 110 of the male connector 10, and a recess 212*b* is formed on the second side wall 212 of each second shielding half shell 210 of the female connector 20. The elastic latch 112*b* is adapted to be latched to the recess 212*b* to lock the male connector 10 and the female connector 20 together.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A male connector, comprising: a shielding shell including: two identical shielding half shells each comprising a bottom wall and a pair of side walls; a protrusion formed on one of the pair of side walls; at least one slotted opening formed through at least one of the side walls of each pair of side walls, the slotted opening having an open end at an edge of the at least one side wall; and a latch formed on the other of the pair of side walls, the latch of one of the two shielding half shells engages with the protrusion of the other of the two shielding half shells for locking the two shielding half shells together; and a terminal module installed in the shielding shell, the terminal module and shielding shell adapted to be received within and electrically connected to a female mating connector; and further comprising a positioning protrusion formed on each lateral side surface of the terminal module, wherein the at least one slotted opening includes a slotted opening formed on each side wall of each shielding shell half for receiving the positioning protrusions and locating the terminal module within the shielding shell in an axial direction of the connector, with the two shielding shell halves locked together, respective pairs of slotted openings of each shielding shell align to form a single, closed slotted opening receiving a respective one of the positioning protrusions therethrough.

2. The male connector according to claim 1, further comprising a cable clip formed at a rear of the bottom wall of each shielding half shell, the cable clips adapted to clamp a cable introduced into the rear of the shielding shell and electrically connecting to the terminal module.

3. The male connector according to claim 2, wherein each cable clip comprises a half annular body part and two ear parts respectively connected to both sides of the half annular body part, the ear parts of the two cable clips are adapted to be fixed together by a bolt to clamp and fix the cable between the half annular body parts of the two cable clips.

4. The male connector according to claim 3, wherein each cable clip further comprises a cantilevered elastic clamping arm formed on the half annular body part and extending radially inward for pressing on the clamped cable.

5. The male connector according to claim 1, further comprising:

a plurality of positioning bumps formed on respective top and bottom surfaces of the terminal module; and a plurality of positioning holes formed in the bottom walls of the two shielding half shells for receiving the positioning bumps.

6. A female connector, comprising: a shielding shell including: two identical shielding half shells each comprising a bottom wall and a pair of side walls; a protrusion formed on one of the pair of side walls; at least one slotted opening formed through at least one of the side walls of each pair of side walls, the slotted opening having an open end at an edge of the at least one side wall; and a latch formed on the other of the pair of side walls, the latch of one of the two shielding half shells engages with the protrusion of the other of the two shielding half shells for locking the two shielding half shells together; and a terminal module installed in the shielding shell, the terminal module and shielding shell adapted to receive therein, and electrically connect to a male mating connector; and further comprising a positioning protrusion formed on each lateral side surface of the terminal module, wherein the at least one slotted opening includes a slotted opening formed on each side wall of each shielding shell half for receiving the positioning protrusions and locating the terminal module within the shielding shell in an axial direction of the connector, with the two shielding shell halves locked together, respective pairs of slotted openings of each shielding shell align to form a single closed slotted opening receiving a respective one of the positioning protrusions therethrough.

7. The female connector according to claim 6, further comprising a cable clip formed at a rear of the bottom wall of each shielding half shell for clamping a cable introduced into the rear of the shielding shell.

8. The female connector according to claim 7, wherein each cable clip comprises a half annular body part and two ear parts respectively connected to both sides of the half annular body part, the ear parts of the two cable clips defining coaxial apertures for receiving a fastener therethrough to clamp and fix the cable between the half annular body parts of the two cable clips.

9. The female connector according to claim 8, wherein each cable clip further comprises an elastic clamping arm formed on the half annular body part and extending radially inward for pressing on the clamped cable.

10. A connector assembly, comprising: a male connector and a female connector, each of the male and female connectors including: a shielding shell having: two identical shielding half shells each comprising a first bottom wall and a pair of side walls; a first locking element formed on one of the pair of side walls; and a second locking element formed on the other of the pair of side walls, the first locking element of one of the two shielding half shells engages with the second locking element of the other of the two shielding half shells for locking the two shielding half shells together; and a terminal module installed in the shielding shell, wherein the male connector is mateable with the female connector such that the terminal module of the male connector is electrically connected to the terminal module of the female connector, with the male connector mated with the female connector, at least a portion of shielding shell of the male connector received within the shielding shell of the female connector; and further comprising: a positioning protrusion formed on each lateral side surface of the terminal modules; and a plurality slotted openings formed on a respective side wall of each shielding shell half for receiving the positioning protrusions and locating the terminal modules within the shielding shells in an axial direction of each connector, the slotted openings each having an open end at an edge of a respective one of the side walls.

11. The connector assembly of claim 10, wherein the first locking elements comprise locking protrusions, and the second locking elements comprise locking latches.

12. The connector assembly according to claim 10, wherein a front end of the shielding shell of the female connector is inserted into a front end opening of the shielding shell of the male connector.

13. The connector assembly according to claim 12, wherein an elastic contact terminal is formed on the side wall of each shielding half shell of the male connector, the elastic contact terminal electrically contacting the side wall of the shielding shell of the female connector.

14. The connector assembly according to claim 12, further comprising:

an elastic latch formed on the side wall of each shielding half shell of the male connector; and a recess formed on the side wall of each shielding half shell of the female connector, the elastic latch engaging with the recess to lock the male connector to the female connector.

15. The connector assembly according to claim 10, wherein:

the male connector further comprises a cable clip formed at a rear of the bottom wall of each first shielding half shell, the cable clips adapted to clamp a first cable introduced into the rear of the shielding shell and electrically connecting to the terminal module; and the female connector further comprises a cable clip formed at a rear of the bottom wall of each shielding half shell, the cable clips adapted to clamp a second cable introduced into the rear of the shielding shell and electrically connecting to the terminal module.

16. The connector assembly according to claim 15, wherein each cable clip includes:

a half annular body part and two ear parts respectively connected to both sides of the half annular body part; and an elastic clamping arm formed on the half annular body part for pressing on the first cable or the second cable.

17. The connector assembly according to claim 16, wherein each elastic clamping arm defines a cantilevered arm extending from the half annular body in a radially inward direction.

* * * * *